US007188975B2

(12) United States Patent
Görres

(10) Patent No.: US 7,188,975 B2
(45) Date of Patent: Mar. 13, 2007

(54) LIGHT FIXTURE FOR ILLUMINATING BUILDING SURFACES OR PARTS THEREOF

(75) Inventor: Markus Görres, Dortmund (DE)

(73) Assignee: Erco Leuchten GmbH, Ludenscheid (DE)

( * ) Notice: Subject to any disclaimer, the term of this patent is extended or adjusted under 35 U.S.C. 154(b) by 42 days.

(21) Appl. No.: 10/940,601

(22) Filed: Sep. 14, 2004

(65) Prior Publication Data

US 2006/0044808 A1 Mar. 2, 2006

(30) Foreign Application Priority Data

Sep. 2, 2004 (DE) ..... 10 2004 042 915

(51) Int. Cl.
*F21V 7/00* (2006.01)

(52) U.S. Cl. ..... 362/297; 362/296; 362/341; 362/346; 362/350

(58) Field of Classification Search ..... 362/296, 362/297, 341, 346, 347, 350
See application file for complete search history.

(56) References Cited

U.S. PATENT DOCUMENTS 2,154,296 A * 4/1939 Winkler ..... 362/433
4,545,000 A * 10/1985 Fraley et al. ..... 362/304
5,272,408 A 12/1993 Levin
6,024,469 A 2/2000 Greif
6,206,549 B1 * 3/2001 Li ..... 362/297
6,270,241 B1 8/2001 Collot
6,361,175 B1 * 3/2002 Kittelmann et al. ..... 359/851
6,454,433 B1 * 9/2002 Alessio ..... 362/157

FOREIGN PATENT DOCUMENTS

| | | |
|---|---|---|
| DE | 19907765 | 8/1998 |
| DE | 19750269 | 5/1999 |
| DE | 19910192 | 9/2000 |
| EP | 69130738 | 2/1994 |

* cited by examiner

*Primary Examiner*—Sandra O'Shea
*Assistant Examiner*—James W Cranson, Jr.
(74) *Attorney, Agent, or Firm*—Andrew Wilford

(57) ABSTRACT

A light fixture is shown and described is for illuminating building surfaces or portions thereof, comprising a generally cup-shaped arcuate reflector (10) having an interior (21) provided with a lamp emitting light at least partially reflected or dispersed by an inner surface (27) of the reflector to the building surface or portion to be illuminated, the inner surface of the reflector being subdivided into a plurality of structured segments (15*a*, 15*b*, 15*c*, 15*d*, 32, 38).

The novelty is that the segments each have a surface (31*a*, 31*b*, 31*c*, 36, 37, 40) that is curved toward the interior.

24 Claims, 3 Drawing Sheets

LIGHT FIXTURE FOR ILLUMINATING BUILDING SURFACES OR PARTS THEREOF

The invention relates to a light fixture for illuminating building surfaces or parts thereof according to the characterizing clause of claim 1.

Such a light fixture was developed in the past by the applicant and is marketed under the name "Parscan." The know light fixture has an aluminum reflector that is generally parabolic. The reflector is formed from an aluminum disk that is rotated and pressed against a pin (male die part). It has after the shaping 10 process an inner surface that conforms to the die and that is formed by the male die part. The known reflector has a plurality of segments that each have a generally planar face. Both seen angularly as well as from an edge of the reflector toward its apex the rows of adjacent segments together form a polygonal course.

It is an object of the invention, starting from this state of the art, to improve on the known light fixture so that homogenous illumination of the building surface is possible.

The invention attains this object with the feature of claim 1, in particular with those of the characterizing clause, and is thus characterized in that the segments each have an inwardly directed arcuate surface.

The principle of the invention is generally that instead of using segments with generally planar faces that ensure a reflection of the light from the lamp in the standard manner, now arcuate surfaces are provided that fan out the individual light elements or ray bundles and thus make them more uniform. In this manner it is possible to reduce the light density on the reflector surface by spreading it over a number of segments. In addition it is possible to minimize stray portions since the curved, in particular generally spherical arcuate segments, can be particularly precisely tuned in advance and correspondingly exactly formed.

While the use of generally planar reflector surfaces produces a reflection obeying the reflection law of Euclid, where the incident light rays have an reflection angle equal to the incident angle, when a parallel bundle of light rays strikes a curved or arcuate surface, e.g. a spherical surface, there is a divergent reflection. The result is that the light density of an individual segment with an arcuate face is less than with a similar segment with a generally planar face.

This leads in general to a homogeneously illuminated building surface or part thereof.

The light fixture according to the invention makes possible a predetermined reflecting characteristic of the light fixture by the selection of the curvature radii of the surfaces of the segments. Here each segments is preferably curved in two directions and thus has a first and a second radius of curvature. By selecting these two curvature radii the reflective characteristic of the fixture can be influenced strongly. Smaller radii lead to a greater fanning-out of the light and are therefore preferred when the fixture is a floodlight so that a large surface of a building can be illuminated. Larger curvature radii produce parallel light beams and are thus used when the fixture is employed as a spotlight and only illuminates a fairly restricted region. e.g. a circular area, of a building surface.

The statement that the light emitted by the lamp is partially only emitted by the fixture after reflection or dispersion on the inner face of the reflector to the building surface or part thereof means that even light can be emitted directly from the lamp onto the building surface being illuminated. Substantial amounts of light, in fact the overwhelming portion of the light from the lamp, does however first impinge the inner face of the reflector.

The building surface or portion thereof is in particular a building wall, a building roof, or a building floor, and for outside fixtures of course paths or streets can be illuminated. The fixture according to the invention is stationary, preferably mounted on a building surface or part thereof, but can also be provided on a pole or the like.

The building surface or portion thereof according to the present application can also be an object on a building surface, e.g. artwork. The fixture according to the invention for illuminating building surfaces or portions thereof can also illuminate an object, which is in particular of interest when the fixture is used as a spotlight.

The structured arrangement of the segments according to the introductory clause of claim 1 includes such segments that are arrayed according to a particular pattern or raster relative to one another. The segments can thus be set in any desired raster. Such a raster is necessary in any case in order to achieve the desired reflecting characteristic of the fixture. Preferably an array is used wherein the segments are set in generally annular arrays extending angularly, the number of segments in each annular array not changing and in fact being constant as the distance of the annular array from the apex changes. As a result it is possible to order the segments from the edge of the reflector to the apex in straight lines, that is in columns.

According to an advantageous embodiment of the invention a lamp is provided or mountable at a focal point of the reflector. This makes it possible to accurately control the reflective characteristic of the fixture. Such positioning of the lamp at the focal point is particularly advantageous when the reflector is generally parabolic. In addition to a parabolic reflector, other cup shapes for the reflector are possible. Of course several lamps can also be mounted inside the reflector. It is mainly important that the light sources be at least near the focal point.

In a further preferred embodiment of the invention the reflector is generally rotation symmetrical. This facilitates a particularly simple shape and manufacture of the reflector as well as a particularly homogeneous illumination of the building surface.

According to a further feature of the invention the surface is double curved. In particular the surface has a first curvature with a first radius and a second curvature with a second radius. The surface of each segment is thus generally part-spherical. This is not necessarily a part of a spherical surface, but a surface curved in three dimensions that is curved along two different radii of curvature. A spherically curved surface is only used in the particular circumstance when the first radius and the second radius are the same. This case is not in the scope of the invention.

By calculating and predetermining these two different radii of curvature, that preferably vary with the spacing between the segment and the apex of the reflector, the reflecting characteristic of the fixture can be determined very accurately. In particular the building surface or part thereof can be carefully and homogeneously illuminated.

Preferably the first and the second radii are different depending on a spacing of the segment from an apex of the reflector. This makes possible a particularly exact predetermining of the reflective characteristic of the fixture.

According to a further advantageous feature of the invention, every two segments are immediately adjacent each other. The entire inner surface of the reflector is formed by the surfaces of the individual segments. This reduces the light density on the reflector surfaces and minimizes stray light.

According to a further advantageous feature of the invention, between an apex of the reflector and a light-output opening of the reflector, there are a plurality of groups of segments arranged in rings. This facilitates a particularly homogeneous illumination of the building surface. In addition the reflective characteristic of the fixture is in this manner subject to being predetermined simply.

According to a further advantageous feature of the invention, the segments are arranged linearly relative to the curved inner face of the reflector. The segments are thus arrayed along a straight line looking into the interior parallel to the rotation axis of the reflector or along its central longitudinal axis. In fact the segments, since the inside of the reflector is itself curved, extend along a curved path that follows the inner shape of the reflector. This curved path is the shortest distance between the apex of the reflector and the edge of the reflector.

According to a further advantageous feature of the invention, the size of the segments increases from an apex of the reflector toward a light-outlet opening of the reflector. This makes it possible to completely fill the inside of the reflector with segments.

In this context it is significant that preferably the entire inner face of the reflector is covered with segments. The segments thus cover the inside of the reflector from its free edge up to its apex, thus up to the opening through which the lamp or a socket for the lamp is inserted, furthermore preferably the number of segments angularly is independent of the spacing of the segments from the apex of the reflector and is constant. This produces a particularly homogeneous illumination of the building surface or part thereof.

According to a further advantageous embodiment of the invention, an edge of the reflector has a rim. This makes it particularly simple to provide mounting formations.

The invention further relates to a light fixture for illuminating building surfaces or parts thereof according to the introductory clause of claim 24.

This invention is also aimed at the already described light fixtures of applicant.

The object of this invention is so to improve the known light fixtures that they are of simpler construction.

The invention attains this object with the features of claim 24, in particular with those of its characterizing clause, and is thus characterized in that the segments each have an inwardly directed arcuate surface, the reflector having a spacing between an apex and a free edge and a light-outlet opening, in particular a generally circular light-outlet opening, with a first diameter, the reflector being interchangeable with a second reflector with the same spacing and the same diameter but having segments that are differently curved from the first reflector.

The principle of this invention is mainly that a first reflector and a second reflector have the same outside dimensions or measurements, also the same spacings and diameter. The first and the second reflectors are thus interchangeable with each other.

As a result there is also the possibility to use the same mounting elements or openings, e.g. mounting means or mounting notches on both the first and the second reflector. Both the first reflector and the second reflector can thus be used in the same fixture, advantageously with the same fasteners.

Above all the two reflectors have differently curved surfaces that are different with respect to their radii fo curvature. Thus for example the first reflector has a plurality of segments that have large radii and the second reflector has a plurality of segments that have smaller radii. As a result the first reflector imparts a first reflective characteristic to the fixture. e.g. that of a standard spotlight, and the second reflector has a reflective characteristic different from that of the first reflective characteristic, that of a standard floodlight. By switching the reflector elements in this manner the reflective characteristic of the fixture can be completely changed without having toe change the entire fixture. It is only necessary to switch the reflector. This is possible since only different radii of curvature are provided and set in the curved surfaces.

The principle according to the invention makes it possible to simplify the necessary expensive construction of different fixtures for different reflective characteristics. It is simply only necessary to make different reflector. The fixtures can be completely identical with regard to the chamber for the reflector, the fixture housing, and the mounting elements for the reflector. Finally even the reflective characteristic of an already installed, that is site-mounted fixture, be changed by switching out the reflector as needed.

It is significant that it is also possible to use the same lamps with different reflectors.

Further features of the invention are seen with reference to the uncited dependent claims as well as to the following description of the embodiments shown in the drawing. Therein:

Figure 1:
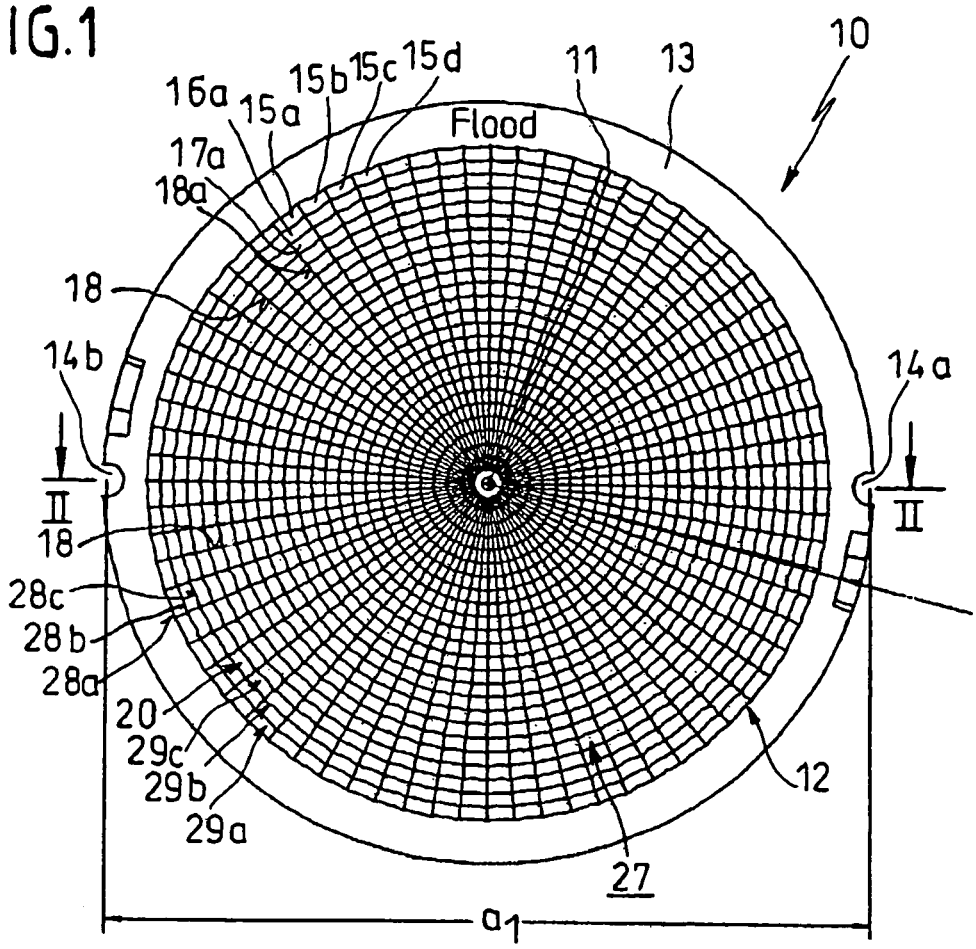
FIG. 1 is a schematic view from below according to view arrow I of FIG. 2 of a first reflector with a plurality of segments with arcuate surfaces.
Figure 2:
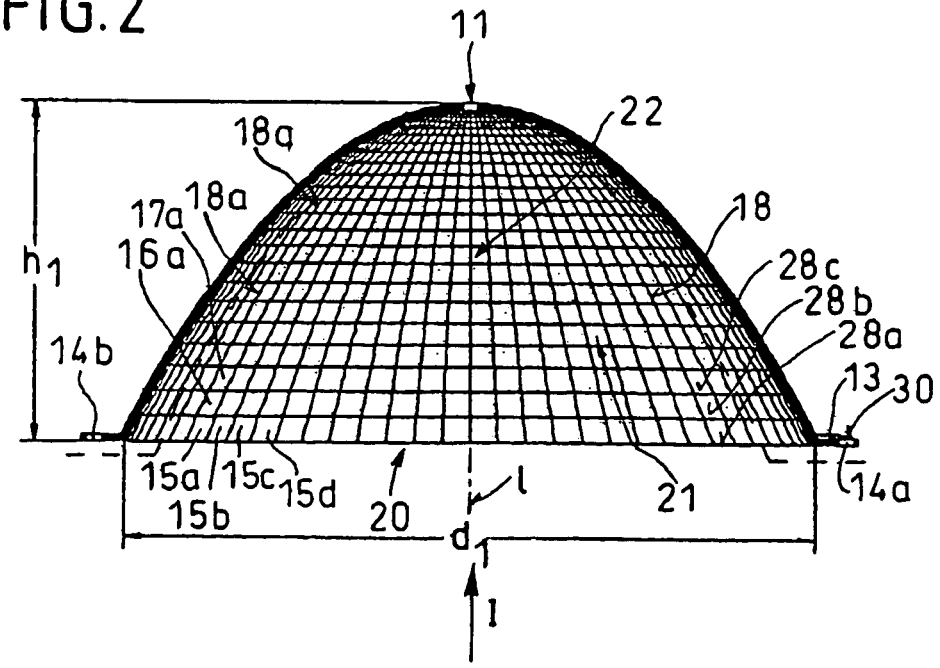
FIG. 2 is the embodiment of FIG. 1 in partial section taken along line II—II of FIG. 1.

The reflector is shown in general in the drawing at 10, and similar parts or elements of the two different embodiments of FIGS. 1 and 2 on one hand and 3 to 6 on the other have the same references for simplicity's sake, partially with the addition of lower-case letters.

FIGS. 1 and 2 show a generally parabolically curved reflector 10 having an apex 11 and an edge 12. The axial distance between the apex 11 and the edge 12, that is the height or apex height of the reflector 10 is shown in FIG. 2 at $h_1$. The edge 12 of the reflector defines a generally circular light-outlet opening 20 of diameter $d_1$. This corresponds thus to the inside diameter $d_1$ of the reflector 10 at its widest part.

At its edge 12 the reflector 10 is spread outward and has a flange 13. On this flange 13 as best shown in FIG. 2 there are two notches 14*a* and 14*b* that serve for mounting. Unillustrated mounting elements, e.g. screws, pass partly through these edge notches 14*a* and 14*b* to secure the reflector in an unillustrated housing of an also unillustrated light fixture. The reflector 10 is thus fitted inside the light fixture. When the fixture is installed, an upper surface 30 of the flange 13 abuts a surface of the fixture housing so that the flange 13 and thus the entire reflector is fixed against this mounting surface.

Of course other alternatives are possible for mounting.

At the apex 11 of the reflector 10 there is a hole not shown in the drawing that is typically formed as an opening at a longitudinal central axis 1 of the reflector 10 at its apex 11. The opening is normally formed by stamping or cutting out of the apex 11. A lamp is inserted through this unillustrated opening so that the lamp 10 when mounted is in an interior 21 of the reflector 10, preferably near a focal point 22 shown only in FIG. 2.

The reflector 10 has on its inner face 27 a plurality of segments. FIG. 1 shows the peripheral adjacent segments by way of example at 15*a*, 15*b*, 15*c*, and 15*d*, with eighty segments in an angular row forming an annular group.

The segments extend from the edge 12 of the reflector 10 up to the apex. As shown in FIG. 1 the segments are arrayed along straight lines 18 that are shown in the view of FIG. 1 to extend from the apex of the reflector 10 to its edge 12. This forms a spider-web structure or raster.

By way of example in FIG. 1 segments 15*a*, 16*a*, 17*a* are shown that extend along the line 18*a*. In general twenty segments extend along this line 18*a* from the apex 11 of the reflector 10 to its edge 12. It is important that the lines 18 and 18*a* are only straight as seen in FIG. 1. Actually the lines 18 and 18*a* follow the parabolic shape of the reflector 10 which is shown in particular in FIG. 2. The line 18 thus extends in the shortest possible route from the edge of the reflector to the apex 11.

FIG. 1 shows that the reflector 10 has a concentric array of circular groups of segments. Thus one group of eight segments forms immediately adjacent the edge 12 of the reflector a circular group 29*a* of segments. Radially inside this group 21*a* and closer to the apex of the reflector 10 there is a second circular group 29*b* of segments. Further radial inward and closer to the apex 11 is a third circular group 29*c* of segments. Overall the number of segments along a straight line corresponds to twenty circular groups 29 of segments. Each group of segments has eighty segments.

Each group 29*a*, 29*b*, 29*c* of segments runs along a circular line 28*a*, 28*b*, 28*c*. All the circular lines 28, 28*a*, 28*b* 28*c* are concentric circles.

The entire inner face 27 of the reflector 10 is covered with segments (e.g. 15*a*, 15*b*, 15*c*, 16*a*, 16*b*, 16*c*). The inner face of the reflector 10 is thus wholly comprised of the individual arcuate surfaces 31*a*, 31*b*, 31*c*, 31*d* of the individual segments. Each segment has its own surface.

Figure 3:
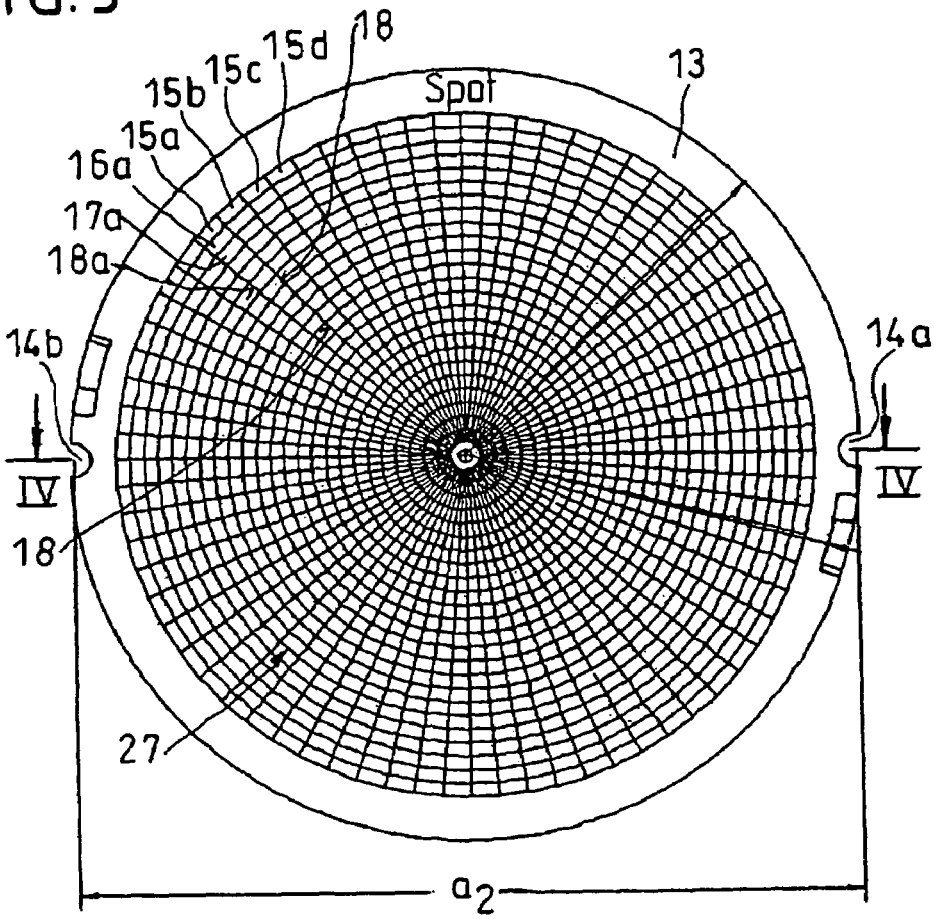
FIG. 3 is a second embodiment of a reflector according to the invention shown as in FIG. 1.
Figure 4:
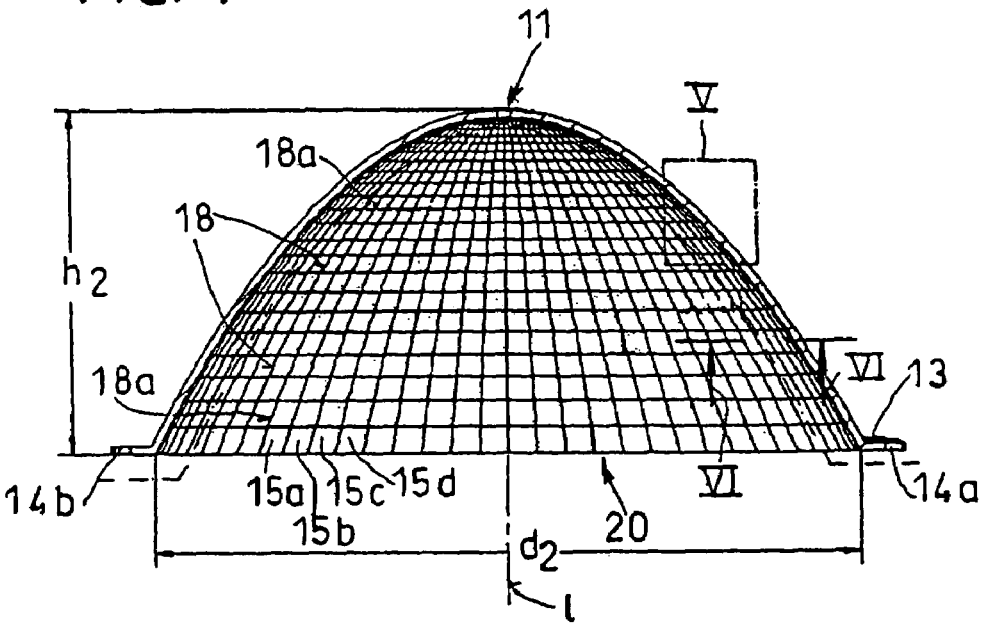
FIG. 4 is the embodiment of FIG. 3 shown as in FIG. 2 but along the section line IV—IV of FIG. 3.

FIGS. 3 and 4 show a further embodiment of the reflector according to the invention, which has the same number of segments. In addition there are eighty segments counting angularly and twenty along a line 18. The reflector 10 according to FIGS. 3 and 4 has a height $h_2$ that is identical to the height $h_1$ of the first embodiment. Even the inside diameter $d_2$ of the light-outlet opening 20 of the reflector 10 is identical to the inside diameter $d_1$ of the first embodiment. Finally an outside diameter $a_2$ of the reflector 10 according to FIGS. 3 and 4 is identical to the outside diameter $a_1$ of the first embodiment. The same is true for the mounting notches 14*a* and 14*b*.

The principal difference between the reflector 10 of FIGS. 1 and 2 and the reflector 10 of FIGS. 3 and 4 is that the individual segments have differently curved surfaces. This is best described with reference to FIGS. 5 and 6.

Figure 5:
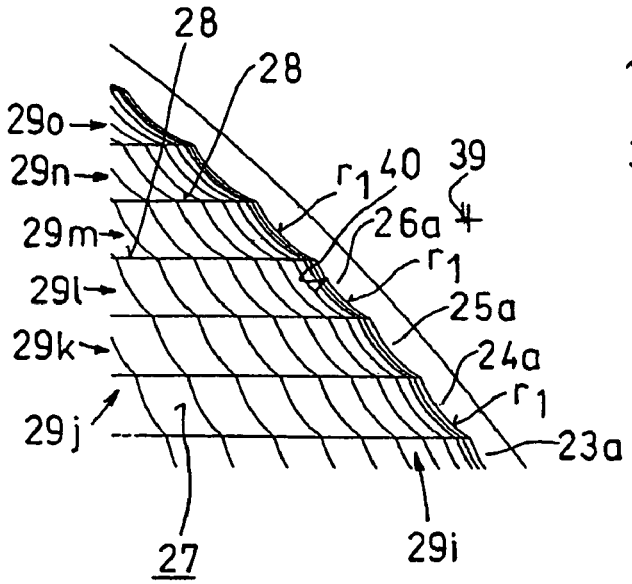
FIG. 5 is an enlarged view of a detail of FIG. 4 as shown by rectangle V.

FIG. 5 shows an enlarged detail from FIG. 4 from somewhere between the edge 12 and the apex 11. In accordance with the numbering of the segments 15*a*, 15*b*, 15*c*, and 15*d* of the outermost circular group 29*a* of segments, FIG. 5 shows by way of example in sectional view segments 23*a*, 24*a*, 25*a*, and 26*a*. In accordance with the above-given numbering of the circular groups 29, FIG. 5 shows a section through the circular groups 29*i*, 29*j*, 29*k*, 29*l*, 29*m*, 29*n*, and 29*o* of segments.

Figure 6:
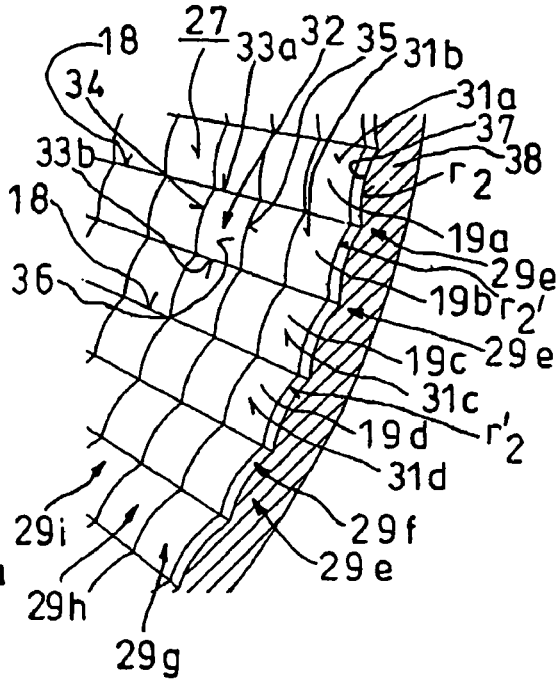
FIG. 6 is an enlarged sectional view of the embodiment of FIG. 4 generally along section line VI—VI of FIG. 4.

Whereas FIG. 5 is a generally vertical section, FIG. 6 is a horizontal section through the reflector 10. In section here the circular group 29*e* of segments is shown. In the view one can see the circular groups 29*f*, 29*g*, 29*h*, and 29*i* of segments as well as further circular groups.

By way of example there is shown with respect to segment 32 that each segment has a generally trapezoidal shape. While the two opposite sides 33*a* and 33*b* that angularly delimit the segment 33 are of substantially the same length, the radially inner side 34 toward the apex 11 of the segment 32 is shorter than the side 35 of this segment 32 closer to the edge 12, so as to produce the trapezoidal shape. It is notable that this trapezoidal shape is only seen in a frontal view of the segment 32. The actual trapezoidal shape is produced when a surface 36 of the segment 32 is projected on a plane. Even seen this way the trapezoidal shape is only approximate since, according to how the surface 36 of the segment 32 is curved the projected surface will not necessarily have straight edges.

The surface 36 is curved in two dimensions. In order to show both curvatures, FIG. 5 shows the radius $r_1$ of curvature while on the other hand FIG. 6 shows the second radius $r_2$ of curvature.

FIG. 6 shows in the group 29*e* of segments shown in section a curvature radius $r_2$. Similarly the surfaces 31*a*, 31*b*, 31*c*, and 31*d* of the respective segments 19*a*, 19*b*, 19*c*, and 19*d* have a corresponding curvature radius $r_2$, but this is not shown. Reference $r_2'$ shows that there is a second curvature radius $r_2$ that represents the curvature of the surface of a segment when the segment is sectioned longitudinally, that is generally perpendicular to the lines 18 delimiting the segment sides.

The curvature radius $r_2'$ of the surfaces 31*a*, 31*b*, 31*c*, and 31*d* of the segments 19*a*, 19*b*, 19*c*, and 19*d* is shown in FIG. 6 but this figure shows these segments 19*a*, 19*b*, 19*c*, and 19*d* in frontal view and not in section so that they are not clearly recognizable.

It is notable that the second curvature radius $r_2$ of the group 29*e* of segments is advantageously different from the curvature radius $r_2'$ of the group 29*g* of segments 19*a*, 19*b*, 19*c*, and 19*d*.

It is significant that all the segments of the group 29*e* are of the same curvature radius $r_2$. This curvature radius $r_2$ defines a curvature of the respective surface 37 of a segment 38 and an unillustrated curvature axis that extends generally parallel to the longitudinal central axis 1 of the reflector 10.

Even the segment 32 that is closer to the apex 11 of the reflector 10 than the last-discussed segment 38 has a curvature with the radius $r_2$ that corresponds to a curvature axis that defines a plane together with the longitudinal central axis 1 of the reflector, that is a section plane for the reflector along which the reflector is divided into two generally identical halves by a longitudinal section like that of FIG. 4. In general the family of curvature axes includes straight lines that intersect the central axis or rotation axis 1 of the reflector 10 and the intersection as in FIG. 2 lies above the apex 11 of the reflector 10.

The radius $r_2$ of the group 29*i* of segments can be different from that of the radius $r_2$ of the group 29*e* of segments.

It is preferable when different groups 29*a*, 29*b*, 29*c*. 29*e*, 29*f*, 29*g*, 29*h*, 29*i*, 29*j*, 29*k*, 29*l*, 29*m*, 29*n*, and 29*o* have different radii $r_2$ with the different segments of each group, e.g. the group 29*e*, having the same radius $r_2$. The radius $r_2$ can change with the spacing of the group 29 of segments from the apex 11, for example continuously.

Each surface of each segment is also arcuate along a further radius $r_1$. This curvature can be seen in FIG. 5.

Thus for example a surface 40 of the segment 26*a* is formed with a radius $r_1$ having a schematically shown curvature axis 39. This curvature axis 39 is generally perpendicular to the longitudinal central axis 1 of the reflector 10. Preferably each segment of a group, e.g. the group 291, has the same curvature radius $r_1$. The individual segments of a group, e.g. the group 291, thus have different curvature axes 39, and the family of curvature axes 39 of a group 291 of segments all lie in the same plane. The longitudinal axis 1 is perpendicular to this plane.

FIG. 5 shows how the segments 23*a*, 24*a*, 25*a*, and 26*a* each have a surface with a curvature radius $r_1$. The individual curvature radii $r_1$ of the different groups 29*j*, 29*k*, 29*l*. etc. of segments are all different.

FIGS. 5 and 6 generally show that the first curvature radius $r_1$ and the second curvature radius $r_2$ vary depending on the spacing of the respective segments from the apex 11 of the reflector 10, while within an annular group 29 of segments they are constant.

From the above description of embodiments it is clear that a first embodiment of a reflector 10 according to FIGS. 1 to 3 can have for example 1600 segments with each segment having a surface that is curved along two different radii $r_1$ and $r_2$. The second embodiment of a reflector 10 according to FIGS. 3 to 6 has the same number and arrangement of segments, but the individual segments have in contrast to the embodiment of FIGS. 1 and 2 differently curved surface surfaces of the segments with other radii $r_1$ and $r_2$. Depending on the size of the radii $r_1$ and $r_2$ of the different segments the reflecting characteristics of the fixture can be varied. Different reflecting characteristics of the fixtures are created simply by changing the radii $r_1$ and $r_2$.

As visible by a comparison of FIGS. 1 and 3 the mounting cutouts 14*a* and 14*b* are identical in the two different reflectors. Thus the same fixture housing and the same mounting means can use either the first embodiment of a reflector according to FIG. 1 or alternatively the second embodiment of a reflector of FIG. 3 without having to do any particular conversions.

It is to be noted that in a spotlight fixture the typical reflecting angle is between 5 and 15° whereas for a floodlight fixture the angle is 50 to 70°. Of course intermediate reflecting angles can be used, and the reflector according to the invention can also be set up for fine increments or degree distributions.

In the embodiment, the fixed number of 1600 segments (eighty measured angularly, twenty radially) is of course arbitrary. It is perfectly possible that two interchangeable reflectors have the same height ($h_1$ and $h_2$), outer diameters ($a_1$ and $a_2$), and diameters ($d_1$ and $d_2$), but have different numbers of segments.

For better understanding it is also noted that in order to achieve a flood effect, that is to get the greatest possible reflecting angle, smaller radii $r_1$ and $r_2$ are used. To get a spot effect generally larger radii $r_1$ and $r_2$ are used.

The reflector 10 is made preferably of pressed aluminum. To this end an aluminum disk of circular shape, is moved along a rotating pin so that the pin (male die part) deforms the aluminum disk. As shown in particular in the section of FIG. 5, the inner face 27 of the reflector 10 is completely free of undercuts. The reflector 10 can therefore be taken from the male die part with no difficulty in a linear movement. The use of pressed aluminum as the material for the reflector ensures that the inner surface 27 is reflective, so that particular treatments are not needed.

Alternatively the reflector can be made for example of injection-molded plastic or glass provided with a reflective surface applied for example by vapor deposition.

The invention claimed is:

1. A light fixture for homogeneously illuminating building surfaces or portions thereof, the fixture comprising a generally cup-shaped arcuate reflector having an interior defined between an apex and a light-outlet opening and generally rotationally symmetrical to a longitudinal central axis; and a lamp emitting light at least partially reflected or dispersed through the outlet opening by an inner surface of the reflector to the building surface or portion to be illuminated, the inner surface of the reflector being subdivided into and completely covered between the outlet and the apex by a plurality of structured segments each having a surface that is curved toward the interior, a plurality of the segments forming an annular group centered on the longitudinal central axis of the reflector, the segments of the annular group all being of the same curvature.

2. The light fixture according to claim 1 wherein the lamp is provided at a focal point of the reflector.

3. The light fixture according to claim 1 wherein the reflector is generally parabolic.

4. The light fixture according to claim 1 wherein the surface is double curved and has a first curvature with a first radius and a second curvature with a second radius.

5. The light fixture according to claim 4 wherein the second curvature with the second radius has a curvature axis that is generally parallel to the longitudinal central axis of the reflector or forms an acute angle therewith.

6. The light fixture according to claim 4 wherein the first curvature with the radius has a curvature axis that is generally perpendicular to the longitudinal central axis of the reflector.

7. The light fixture according to claim 4 wherein the first and the second radii are different depending on a spacing of the respective segments from the apex of the reflector.

8. The light fixture according to claim 4 wherein the first radius or the second radius are different depending on a spacing of the respective segments from an apex of the reflector.

9. The light fixture according to claim 4 wherein the first radius or the second radius increases with increased spacing of the respective segment from the apex of the reflector.

10. The light fixture according to claim 1 wherein every two segments are immediately adjacent each other.

11. The light fixture according to claim 1 wherein the segments of the group are distributed in a circular annulus angularly in the reflector.

12. The light fixture according to claim 11 wherein between the apex of the reflector and the light-output opening of the reflector, there are a plurality of the groups of the segments arranged in rings.

13. The light fixture according to claim 11 wherein the number of segments measured angularly is independent of a spacing to the apex of the reflector and constant.

14. The light fixture according to claim 1 wherein the segments are arranged linearly relative to the curved inner surface of the reflector.

15. The light fixture according to claim 1 wherein the size of the segments increases from the apex of the reflector toward the light-outlet opening of the reflector.

16. The light fixture according to claim 1 wherein each segment has a generally trapezoidal shape.

17. The light fixture according to claim 1 wherein a generally circular annular edge of the reflector defines the light-outlet opening.

18. The light fixture according to claim 1 wherein the light fixture is stationary.

19. The light fixture according to claim 1 wherein an edge of the reflector has a rim.

20. The light fixture according to claim 1 wherein mounting elements or mounting openings, or mounting means are provided on the reflector.

21. The light fixture according to claim 1 wherein adjacent the apex of the reflector there is a hole through which engages a lamp or a mounting socket for a lamp.

22. A light fixture for illuminating building surfaces or portions thereof, comprising a generally cup-shaped arcuate reflector having an inner surface with a plurality of segments each having an inwardly directed arcuate surface the reflector having a spacing between an apex and a free edge and a light-outlet opening, with a first diameter, the reflector being interchangeable with a second reflector with the same spacing and the same diameter but having segments that are differently curved from the first reflector.

23. A light fixture for illuminating building surfaces or portions thereof, the fixture comprising a generally cup-shaped arcuate reflector having an interior; and a lamp emitting light at least partially reflected or dispersed by an inner surface of the reflector to the building surface or portion to be illuminated, the inner surface of the reflector being subdivided into a plurality of structured segments each having a surface that is curved toward the interior, a plurality of the segments forming an annular group centered on the longitudinal central axis of the reflector, the inner surface of the reflector being completely free of undercuts.

24. A light fixture for illuminating building surfaces or portions thereof, the fixture comprising a generally cup-shaped arcuate reflector having an interior; and a lamp emitting light at least partially reflected or dispersed by an inner surface of the reflector to the building surface or portion to be illuminated, the inner surface of the reflector being subdivided into a plurality of structured segments each having a surface that is curved toward the interior, a plurality of the segments forming an annular group centered on the longitudinal central axis of the reflector, the reflector being made of pressed aluminum.

* * * * *